US005969277A

United States Patent [19]

Adrien et al.

[11] Patent Number: 5,969,277

[45] Date of Patent: Oct. 19, 1999

[54] STEEL FOR SHAPING TOOLS

[75] Inventors: Jacques Adrien, Le Chesnay; Remi Bertrand, Les Mesnuls, both of France

[73] Assignee: Thyssen France SA, Maurepas, France

[21] Appl. No.: 09/043,432

[22] PCT Filed: Jul. 17, 1997

[86] PCT No.: PCT/FR97/01328

§ 371 Date: Apr. 1, 1998

§ 102(e) Date: Apr. 1, 1998

[87] PCT Pub. No.: WO98/03692

PCT Pub. Date: Jan. 29, 1998

[30] Foreign Application Priority Data

Jul. 19, 1996 [FR] France ..... 96 09080

[51] Int. Cl.[6] ..... C22C 38/22; C22C 38/24

[52] U.S. Cl. ..... 75/246; 75/239; 420/10; 420/111; 420/107

[58] Field of Search ..... 75/246, 239; 420/10, 420/107, 111; 148/321

[56] References Cited

U.S. PATENT DOCUMENTS

| | | | |
|---|---|---|---|
| 3,150,444 | 9/1964 | Reen . | |
| 5,403,372 | 4/1995 | Uchida | 75/236 |

FOREIGN PATENT DOCUMENTS

| | | |
|---|---|---|
| 377307 | 7/1990 | European Pat. Off. . |
| 781083 | 8/1957 | United Kingdom . |

*Primary Examiner*—Deborah Yee
*Attorney, Agent, or Firm*—Herbert Dubno

[57] ABSTRACT

A steel obtained via the metallurgy of a high purity pre-alloyed, agglomerated and densified powder, the steel has the following weight composition: Manganese <1%, silicon <1%, chromium 4.50–6.45%, molybdenum 4–6%, vanadium 6.10–6.5%, tungsten 18.20–18.70%, sulfur <0.0020%, phosphorus ≦0.030%, oxygen ≦100 ppm, cobalt 5–7%, nitrogen 0.050–0.080%, ≦aluminum 0.020%, carbon 1.80–1.95%, balance iron and the impurities which are characteristic of producing steel. The steel has for the most part a dispersion of vanadium MC type carbides.

2 Claims, No Drawings

STEEL FOR SHAPING TOOLS

CROSS REFERENCE TO RELATED APPLICATIONS

This application is a national stage of PCT/FR 97/01328 filed Sept. 17, 1997 and based, in turn, on French National application 96 09 080 filed Jul. 19 1996.

FIELD OF THE INVENTION

The present invention relates to a steel for producing a shaping tool.

BACKGROUND OF THE INVENTION

As in the aviation, munitions and associated industries, material are machined still having greater mechanical resistance, it is clear that it is essential to have an extremely hard fast cut steel which, via the metallurgy of the powders, possesses high toughness, thus offering extremely high level resistance of the positive, cut edges.

OBJECT OF THE INVENTION

The object of the present invention is to provide a fast cut steel produced initially by powder netallurgy the steel proving to be extremely hard with a scale <<C>>Rockwell hardness of between 68 and 70 Rc.

DESCRIPTION OF THE INVENTION

This steel, obtained from a pre alloyed agglometated powder, has the following composition:

| Weight percentages: | Preferred bracket | Wide bracket |
|---|---|---|
| Manganese | 0.2–0.40 | <1% |
| Silicon | 0.2–0.40 | <1% |
| Chromium | 4.50–5 | 4.50–6, 45% |
| Molybdenum | 4.50–5 | 4–6% |
| Vanadium | 6.10–6.50 | 6.10–6.50 |
| Tungsten | 18.20–18.70 | 18.20–18.70 |
| Sulphur | ≦0.015% | ≦0.020% |
| Phosphorus | ≦0.020% | ≦0.030% |
| Oxygen | ≦100 ppm | <100 ppm |
| Cobalt | 5.40–6.20% | 5–7% |
| Nitrogen | 0.050–0.080% | 0.050–0.080% |
| Aluminum | ≦0.015% | ≦0.020% |
| Carbon | 1.83–1.90% | 1.80–1.95% |

Balance: Iron and usual steel-making impurities.

The steel has a dispersed phase mainly composed of vanadium MC type carbidos. The steel of the present invention possesses remarkable toughness, due mostly to a particular distribution of primary carbides associated with extremely good elevated temperature hardness. In addition to the hardness elevated temperature hardness, resistance to wear and an exceptional toughness, the family of steels of the present invention can be paticuulay adapted to the shaping of tools machinability, hardenability and wettability.

The carbon content limited to 1.95% is significant. Beyond this value, the matrix would be rendered brittle. The low oxygen content, less that 100 ppm, prevents the oxygen from forming an oxide film on the surface which could create a large network of oxides in the steel following isostatic compaction. This oxygen content, combined with a nitrogen content of less than 800 ppm, guarantees 'super clean' products.

The stoichiometric relation for forming vanadium carbite (Face centered Cubic MC type) is 1% of vanadium for 0.020% of carbon. The carbon content of the steel is balanced with its contents of vanadium, chromium, molybdenum and tungsten to provide a sufficient amount of carbon and thus enable it to be heat-treated so as to obtain a hardness of 66Hrc.

According to the invention, the steel for shaping tools possesses a combination of different qualities: resistance to wear, elevated temperature hardness characterised by the Mathon cutting capacity test, a toughness not previously having been able to be obtained until now.

Toughness is determined via a measurement according to the Charpy test referred to in the standard ASTM-23-92 and 23-93. A 10×10×55 mm reference test piece is treated at 1.160° C. stopped in oil or an isotherm stoppage at 560° C., followed by three annealings of one hour at 560° C. It then exhibits a toughness of more than 40 day/cm2. The cuttin capacity is characterised by the MATHON test (defined in the standard AFNOR A.03.654).

We claim:

1. A powder-metallurgy formed from a high-purity agglomerated densified pre-alloyed powder and having the following weight composition:

| | |
|---|---|
| Manganese | <1% |
| Silicon | <1% |
| Chromium | 4.50–6.45% |
| Molybdenum | 4–6% |
| Vanadium | 6.10–6.5% |
| Tungsten | 18.20–18.70% |
| Sulfur | ≦0.0020% |
| Phosphorus | ≦0.030% |
| Oxygen | ≦100 ppm |
| Cobalt | 5–7% |
| Nitrogen | 0.050–0.080% |
| Aluminum | ≦0.020% |
| Carbon | 1.83–1.90% |
| Balance iron and usual steel-making impurities. | |

2. The steel according to claim 1 having the following composition by weight:

| | |
|---|---|
| Manganese | 0.20–0.40 |
| Silicon | 0.20–0.40 |
| Chromium | 4.50–5% |
| Molybdenum | 4.50–5% |
| Vanadium | 6.10–6.50% |
| Tungsten | 18.20–18.70% |
| Sulfur | ≦0.0015% |
| Phosphorus | ≦0.020% |
| Oxygen | ≦100 ppm |
| Cobalt | 5.40–6.20% |
| Nitrogen | 0.050–0.080% |
| Aluminum | ≦0.015% |
| Carbon | 1.83–1.90% |

Balance iron and usual steel-making impurities.

* * * * *